US006065646A

United States Patent [19]

Schwaikert

[11] Patent Number: 6,065,646

[45] Date of Patent: May 23, 2000

[54] HOUSEHOLD PRODUCT PACKAGE

[75] Inventor: William E. Schwaikert, Lakeville, Conn.

[73] Assignee: First Preference Products Corp., Lakeville, Conn.

[21] Appl. No.: 09/306,284

[22] Filed: May 6, 1999

Related U.S. Application Data

[60] Provisional application No. 60/092,122, Jul. 9, 1998, provisional application No. 60/090,697, Jun. 24, 1998, and provisional application No. 60/084,733, May 8, 1998.

[51] Int. Cl.[7] ..... B67D 5/60

[52] U.S. Cl. ..... 222/143; 220/23.6; 206/509

[58] Field of Search ..... 222/143; 220/23.6, 220/23.86; 215/10; 206/503, 509, 511, 512

[56] References Cited

U.S. PATENT DOCUMENTS

| | | | |
|---|---|---|---|
| D. 181,947 | 1/1958 | Scanland . | |
| D. 220,831 | 6/1971 | Zimmerman et al. . | |
| 769,171 | 9/1904 | Kray . | |
| 1,735,885 | 11/1929 | Towle . | |
| 2,111,884 | 3/1938 | Cahaney . | |
| 2,299,277 | 10/1942 | Neuschaefer . | |
| 2,641,374 | 6/1953 | Der Yuen . | |
| 2,661,872 | 12/1953 | Trautvetter . | |
| 3,176,879 | 4/1965 | Mojonnier . | |
| 3,250,434 | 5/1966 | Howlett | 222/143 |
| 3,474,843 | 10/1969 | Maris . | |
| 3,765,574 | 10/1973 | Urquiza . | |
| 4,545,487 | 10/1985 | Asmus | 206/509 |
| 4,570,799 | 2/1986 | Mednis | 206/509 |
| 4,632,268 | 12/1986 | Melzi et al. . | |
| 4,664,260 | 5/1987 | Stokes . | |
| 4,691,828 | 9/1987 | Slusarczyk et al. . | |
| 4,708,253 | 11/1987 | Mednis | 215/10 |
| 4,711,356 | 12/1987 | Dunden | 206/503 |
| 4,805,793 | 2/1989 | Brandt et al. . | |
| 4,851,351 | 7/1989 | Akamine . | |
| 5,002,199 | 3/1991 | Frahm . | |
| 5,119,972 | 6/1992 | Reed et al. . | |
| 5,199,570 | 4/1993 | McKenzie . | |
| 5,265,743 | 11/1993 | Frohn . | |
| 5,271,515 | 12/1993 | Berkheimer et al. | 206/503 |
| 5,299,710 | 4/1994 | Welsch et al. . | |
| 5,480,028 | 1/1996 | Robinson . | |
| 5,573,698 | 11/1996 | Mandler et al. . | |
| 5,779,051 | 7/1998 | Boutin . | |
| 5,782,358 | 7/1998 | Walker | 206/509 |

*Primary Examiner*—Joseph A. Kaufman
*Assistant Examiner*—Thach Bui
*Attorney, Agent, or Firm*—Akin, Gump, Strauss, Hauer & Feld, L.L.P.

[57] ABSTRACT

A container for dispensing a product is provided. The container is a generally parallelepiped container including first and second lateral, opposite side panels and first and second longitudinal, opposite side panels. Each side panel is interconnected with adjacent side panels, and each side panel has a lower and an upper edge. A bottom panel extends from and interconnects the lower edges of each of the lateral and longitudinal side panels. A top panel extends from and interconnects the upper edges of each of the lateral and longitudinal side panels. A dispensing neck extends generally upwardly from the top panel. A cover member is removably disposed over the dispensing neck. The bottom panel has a recessed area which includes a first groove and a second groove. An intersection of the first and second grooves is generally aligned with the dispensing neck. The recessed area further has a height such that when a plurality of such packages are stacked one on top of another the neck and the cover member of each underlying package is received within the recessed area of an overlying package such that none of the weight of any overlying package is borne by the cover member and neck of an underlying package and so that a package can be displaced in one of a first and second lateral and a first and second longitudinal direction from the stack of packages.

20 Claims, 3 Drawing Sheets

HOUSEHOLD PRODUCT PACKAGE

CROSS REFERENCE TO RELATED APPLICATIONS

This application claims the benefit of U.S. Provisional Application No. 60/092,122, filed Jul. 9, 1998, U.S. Provisional Application No. 60/090,697, filed Jun. 24, 1998, and U.S. Provisional Application 60/084,733, filed May 8, 1998.

BACKGROUND OF THE INVENTION

The present invention relates generally to packaging and, more particularly, to packaging for products such as household products, particularly such packaging which is suitable for, but not restricted to, dispensing from coin operated or other automated dispensing equipment.

Currently, many household products, particularly individual portions of household products such as laundry detergent, bleach, etc. which are dispensed from machines, such as in laundromats, are rectangular packages of standard dimensions to facilitate dispensing from within two primary types of coin operated dispensing equipment. The packaging of powders, liquids and sheets generally use rectangular paperboard cartons of a predetermined length, width and height to fit the specifications of the dispensing machinery. Liquids are first packaged in flexible liquid tight substrates or pouches and are then placed in paperboard cartons of a suitable size and shape so that they may also be dispensed with the same equipment. Conventional liquid packages positioned so that the opening feature is on a horizontal plane and having a size and shape to fit the specifications of existing dispensing machinery have also been used. Such extant packaging is problematic in that product leakage is a significant factor resulting in potential personal injury and property damage. In addition, the cost of providing such packaging is high.

Other packages, such as those disclosed by U.S. Pat. Nos. 2,299,277, 2,641,374, 4,708,253, 4,805,793, 5,002,199, and 5,480,028 disclose a variety of stackable packages which have generally parallelepiped shapes, dispensing necks, and clearance areas to permit stacking of packages. However, these patents also disclose engagement of the bottom surface of the overlying package with the top surface of the underlying package in a locking arrangement which is unsuitable for use in dispensing equipment. While still other packages, such as those disclosed by U.S. Pat. Nos. 2,111,884, 3,176,879, 3,474,843, 3,765,574, 5,265,743, 5,299,710, 5,779,051, Des. 181,947, and Des. 220,831 disclose stackable packages without locking engagement, none of the afore-mentioned patents disclose stackable packages that can be utilized in a dispensing machine.

The present invention comprises a universal polymeric package which can be, but does not have to be, used for dispensing powders, liquids or virtually anything else from a standard coin operated or other dispensing machine Packaging made in accordance with the present invention is structurally superior to prior art packaging due to the position and vertical location of the opening featured and the design which permits a multiplicity of such packages to be stacked one on top of the other without creating undue pressure on the opening feature or other portion of the bottom package or any intervening package which could result in breakage or leakage.

SUMMARY OF THE INVENTION

Briefly, the invention is a package for containing a product for use with standard dispensing equipment. The package comprises a generally parallelepiped container including first and second lateral, generally parallel, opposite side panels and first and second longitudinal, generally parallel, opposite side panels. Each side panel is interconnected with adjacent side panels, and each side panel has a lower edge and an upper edge. The container further includes a bottom panel extending from and interconnecting the lower edges of each of the lateral and longitudinal side panels, and a top panel extending from and interconnecting the upper edges of each of the lateral and longitudinal side panels. The package further comprises a dispensing neck extending generally upwardly from the top panel The dispensing neck has an open end, a predetermined length, a predetermined width and a predetermined height. The package further comprises a cover member removably disposed over the open end of the dispensing neck. The cover member has a predetermined length, a predetermined width and a predetermined height. The bottom panel has a recessed area. The recessed area includes a first groove extending between the longitudinal side panels of the package and having a width at least slightly greater than one of the longer and the wider of a combination of the dispensing neck and the cover member, and a second groove extending between the lateral side panels of the package and having a width at least slightly greater than the other of the longer and the wider of the combination of the dispensing neck and the cover member. An intersection of the first and second grooves is generally aligned with the dispensing neck. The recessed area further has a height at least slightly greater than a combination of the height of the dispensing neck and the cover member disposed above the dispensing neck whereby when a plurality of such packages are stacked one on top of another the dispensing neck and the cover member of each underlying package is received within the recessed area of an overlying package such that none of the weight of any overlying package is borne by the cover member and dispensing neck of an underlying package. The packages can be stacked on top of one another within standard dispensing equipment. A package can be displaced in one of a first and second lateral and a first and second longitudinal direction from the stack of packages for dispensing from the standard dispensing equipment.

The invention is also a package for containing a product. The package comprises a generally parallelepiped container including first and second lateral, generally parallel, opposite side panels and first and second longitudinal, generally parallel, opposite side panels. Each side panel is interconnected with adjacent side panels, and each side panel has a lower edge and an upper edge. The container further includes a bottom panel extending from and interconnecting the lower edges of each of the lateral and longitudinal side panels, and a top panel extending from and interconnecting the upper edges of each of the lateral and longitudinal side panels. The package further comprises a dispensing neck extending generally upwardly from the top panel. The dispensing neck has an open end, a predetermined length, it predetermined width and a predetermined height. The package further comprises a cover member removably disposed over the open end of the dispensing neck. The cover member has a predetermined length, a predetermined width and a predetermined height. The bottom panel has a recessed area. The recessed area includes a first groove extending between the longitudinal side panels of the package and having a width at least slightly greater than one of the longer and the wider of a combination of the dispensing neck and the cover member, and a second groove extending between the lateral side panels of the package and having a width at least slightly greater than the other of the longer and the wider of the combination of the dispensing neck and the cover member. An intersection of the first and second grooves is generally aligned with the dispensing neck. The recessed area further has a height at least slightly greater than a combination of the height of the dispensing neck and the cover member disposed above the dispensing neck whereby when a plurality of such packages are stacked one on top of another the dispensing neck and the cover member of each underlying package is received within the recessed area of an overlying package such that none of the weight of any overlying package is borne by the cover member and dispensing neck of an underlying package. The packages can be stacked on top of one another. A bottommost package can be displaced in one of a first and second lateral and a first and second longitudinal direction from the stack of packages for dispensing.

BRIEF DESCRIPTION OF THE SEVERAL VIEWS OF THE DRAWINGS

The following detailed description of presently preferred embodiments of the invention will be better understood when read in conjunction with the appended drawings. For the purpose of illustrating the invention, there are shown in the drawings embodiments which are presently preferred. It should be understood, however, that the present invention is not limited to the particular arrangements and instrumentalities shown. In the drawings.

DETAILED DESCRIPTION OF THE INVENTION

The present invention comprises a package for containing a product such as household goods or other products of the type which can be, but does not have to be, dispensed from a standard coin operated or other dispensing machine. In particular, the presently described embodiment of the present invention comprises a standard sized package which is sized to be usable within standard dispensing machines and which has substantial structural integrity such that a large number of such packages, with the product therein, can be stacked one upon another without resulting in damage, leakage or the like to the bottom package or any of the intervening packages.

Figure 1:
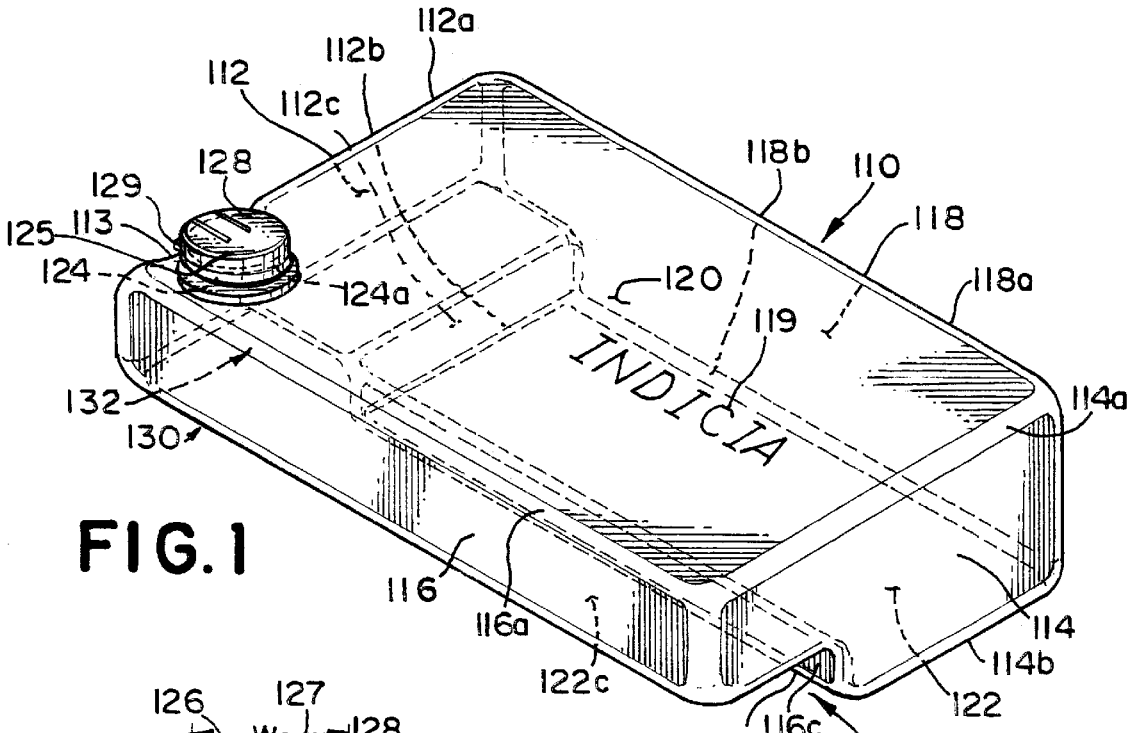
FIG. 1 is a perspective view of a package in accordance with a first preferred embodiment of the present invention.

FIG. 1 illustrates a package 110 in accordance with a first preferred embodiment of the present invention. The package 110 is generally a parallelepiped container in overall shape with first and second generally parallel opposite, lateral side panels 112 (in phantom), 114, first and second generally parallel opposite longitudinal side panels 116, 118 (in phantom) and generally parallel opposite top and bottom panels 120, 122 (in phantom), respectively. Each side panel 112, 114, 116, 118 is interconnected with adjacent side panels as shown in FIG. 1. Each side panel 112, 114, 116, 118 has an upper edge 112*a*, 114*a*, 116*a*, 118*a* and a lower edge 112*b*, 114*b*, 116*b*, 118*b*, respectively.

The top panel 120 extends from and interconnects the upper edges 112*a*, 114*a*, 116*a*, 118*a*, of each of the side panels 112, 114, 116, 118, respectively. The top panel 120 also includes a generally cylindrically shaped dispensing neck 124 extending generally upwardly from the plane of the top panel 120. Preferably, for reasons that will become apparent, part of one of the panels 112, 114, 116, 118 (panel 112 as shown in FIGS. 1–3) includes a panel indentation 113 proximate to the dispensing neck 124.

Preferably, the dispensing neck 124 is generally located proximate to an edge formed by the top panel 120 and the upper edges 112*a*, 114*a*, 116*a*, 118*a* of an adjacent side panel 112, 114, 116, 118, respectively. More preferably, the dispensing neck 124 is generally located proximate to a corner formed by the top panel 120 and the upper edges 112*a*, 114*a*, 116*a*, 118*a* of two adjacent side panels 112, 114, 116, 118, respectively. In the illustrated embodiment, indicia 119 in the form of a preprinted label, is secured to the top panel 120 by a suitable adhesive. However, it will be appreciated by those skilled in the art that the indicia 119 could be applied to the top panel 120 in any other manner and, if desired, could be formed as an integral or molded in part of the top panel 120 during the manufacturing process.

Preferably, the dispensing neck 124 is right circular cylindrically shaped, although those skilled in the art will realize that the dispensing neck 124 can be other shapes, including, but not limited to, right oval cylindrically shaped or frusto-conically shaped. Referring to FIGS. 2–3, the dispensing neck 124 has a tapered lip 124*a* surrounding an open end 125, a predetermined length $L_{n1}$, a predetermined width $W_{n1}$, and a predetermined height $H_{n1}$. The lip 124*a* has a lip indentation 124*b* aligned with the panel indentation 113.

Figure 2:
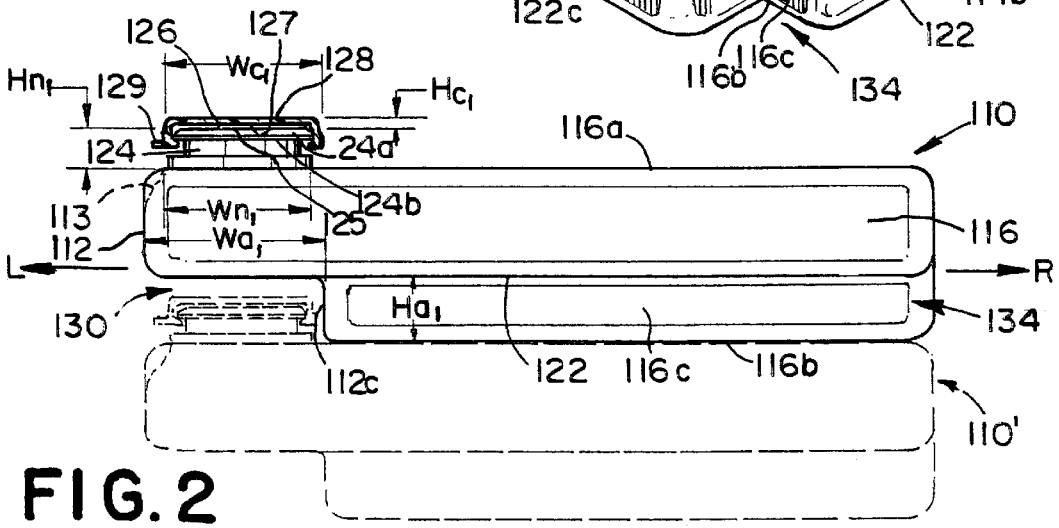
FIG. 2 is a longitudinal side elevational view, partially in section, of the package of FIG. 1 overlying a second package shown in phantom.
Figure 3:
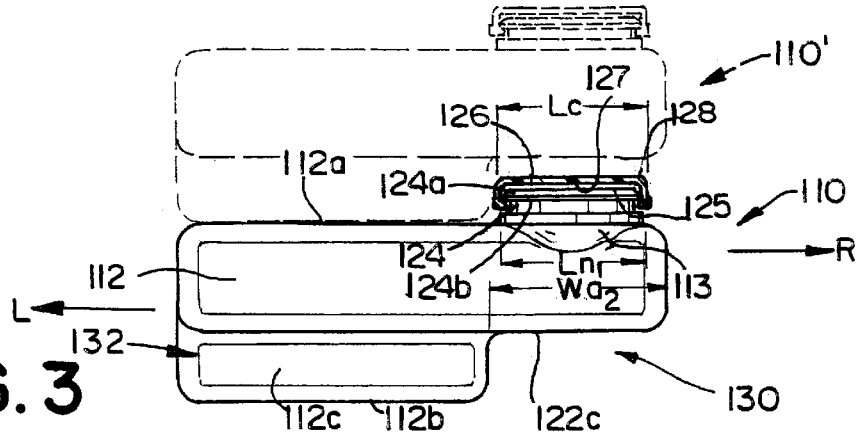
FIG. 3 is a lateral left side elevational view, partially in section, of the package of FIG. 1 underlying a second package shown in phantom.

In the first embodiment, as shown in FIGS. 2–3, the dispensing neck 124 is sealed by a seal 126 which is removably disposed over the open end 125 of the dispensing neck 124. Preferably, the seal 126 includes a tab 127, which a user can grasp to remove the seal 126 from the dispensing neck 124. Preferably, the seal 126 is made of Tyvek® or some other breathable fabric to allow gases which may build up in the package 110 to be released from the package 110 without leaking any product held within the package 110. Alternatively, the seal 126 can be selected from the group consisting of polymeric films, aluminum foils, metallic foils, paper foils, leak proof films, leak proof foils, polypropylene, polyvinyl chloride, polyethylene, and polystyrene. The seal 126 can be secured to the dispensing neck 124 by one of an adhesive, induction sealing, and sonic welding or other comparable methods known to those skilled in the art.

Preferably, the seal 126 is covered by a cover member 128 which is rotatably affixed over the lip 124*a* of the dispensing neck 124. The cover member 128 also includes a tab 129. The cover member 128 is preferably a child proof or child resistant closure. The cover member 128 has a predetermined length $L_{c1}$, a predetermined width $W_{c1}$, and a predetermined height $H_{c1}$ above the dispensing neck 124. The cover member 128 can be of a type that must be torn or otherwise damaged to be removed from the package 110, precluding the reuse of the cover member 128 on the package 110. Alternatively, a screw-on cap (not shown) can be used with a threaded dispensing neck (not shown), permitting the package 110 to be opened and reclosed for partial dispensing of the product contained therein and/or resealing of the package 110. It should be understood by those of ordinary skill in the art that the package 110 and, in particular, the dispensing neck 124 could alternatively be closed in some other manner. For example, the open end 125 of the dispensing neck 124 could be covered by a resealable or non-resealable foil, a flip-top cap or the like. Accordingly, the present invention is not limited to a particular manner in which the package 110 may be initially closed or subsequently re-closed or even whether the package may be reclosable. However, those skilled in the art will also realize that the cover member 128 with tab 129 can be omitted without departing from the spirit and scope of the present invention. The lip 124*a* can also be omitted, and the open end 125 of the dispensing neck 124 can be flat, instead of tapered.

The bottom panel 122 extends from and interconnects the lower edges 112*b*, 114*b*, 116*b*, 118*b* of each of the side panels 112, 114, 116, 118, respectively. The package 110 includes a recessed area 130 on the bottom panel 122. The recessed area 130 is formed by panels 112*c*, 116*c*, and 122*c* as shown in FIG. 1. The recessed area 130 is comprised of a first groove 132 which extends along the entire length of the lateral side panel 112 between longitudinal side panels 116 and 118, and a second groove 134 which extends along the entire length of the longitudinal side panel 116 between lateral side panels 112 and 114 as shown in FIG. 1. The first and second grooves 132, 134 intersect at a location which is generally aligned with the dispensing neck 124.

As seen in FIG. 2, the first groove 132 has a width $W_{a1}$ which is at least slightly greater than one of the longer and the wider of a combination of the dispensing neck 124 and the cover member 128. Likewise, as seen in FIG. 3, the second groove 134 has a width $W_{a2}$ which is at least slightly greater than the other of the longer and the wider of the combination of the dispensing neck 124 and the cover member 128.

Additionally, a height $H_{a1}$, of the recessed area 130 is slightly greater than a combination of the height $H_{n1}$ of the dispensing neck 124 and the height $H_{c1}$ of the cover member 128 disposed above the dispensing neck 124. The recessed area 130 thus effectively establishes clearance sufficient to permit the stacking of a plurality of packages 110, one on top of the other within standard dispensing equipment (not shown), in a manner illustrated in FIGS. 2 and 3 so that the cover member 128 and the dispensing neck 124 of each underlying package 110' (in FIG. 2), 110 (in FIG. 3) is received within the recessed area 130 of an overlying package 110 (in FIG. 2), 110' (in FIG. 3). In this manner, the cover member 128 and the dispensing neck 124 of each underlying package 110 do not engage the bottom panel 122 of any overlying package 110 and therefore do not bear the weight of any packages stacked thereon. It will be appreciated that by positioning the dispensing neck 124 within the recessed area of an overlying package, it is feasible to dispense the bottommost, the topmost, or any other package 110, 110' from a series of stacked packages for dispensing from the standard dispensing equipment by merely displacing the package 110, 110' in any of a first and second longitudinal and a first and second lateral direction, i.e. toward the left or right (arrows "L" and "R", respectively) when viewing FIG. 2 or toward the left or right (arrows "L" and "R", respectively) when viewing FIG. 3.

An intersection of any panel 112, 112*c*, 114, 116, 116*c*, 118, 120, 122, 122*c* with an adjacent panel 112, 112*c*, 114, 116, 116*c*, 118, 120, 122, 122*c* forms an edge. An intersection ofany panel 112, 112*c*, 114, 116, 116*c*, 118, 120, 122, 122*c* with two adjacent panels 112, 112*c*, 114, 116, 116*c*, 118, 120, 122, 122*c* forms a corner. Preferably, any and all edges and comers that are formed on the package 110 are rounded. The rounding relieves stress concentrations at the comers and edges.

As stated above, the dispensing neck 124 is more preferably located proximate to a comer of the top panel 120 (shown as the comer formed by panels 112, 116, and 120). Locating the dispensing neck 124 in a comer facilitates pouring of a liquid or powder from the package 110 and provides a larger, generally continuous area on the top panel 120 for the placement of the indicia 119 indicative of the contents of the package 110.

It will be appreciated by those skilled in the art that, while it is more preferred that the dispensing neck 124 is located proximate to a comer of the package 110, the dispensing neck 124 may be located in virtually any position along any of the edges of the top panel 120 as long as the recessed area 130 is suitably sized and positioned under the dispensing neck 124 to facilitate proper stacking and dispensing of the bottommost package 110.

By having the dispensing neck 124 extend above the plane, of the top panel 120 of the container 110, the level of any liquid in the container, when stored in an upright level condition, is never high enough to be in contact with an interior of the seal 126. In this manner, the potential for deterioration of the seal 126 and subsequent product leakage is diminished.

Preferably, the package 110 is made of a strong polymeric material, such as a polypropylene, polyvinyl chloride, polyethylene, polystyrene or the like in monolayers or multilayers in order to provide a strong, lightweight, inexpensive package which guards against leakage of any product contained therein. Preferably, the package 110 is made utilizing a known molding or blow molding process in a manner well known to those of ordinary skill in the art.

It will also be appreciated by those of ordinary skill in the art that while the present package 110 may be best suited to dispense liquid products, the package 110 could be used for dispensing solid or semi-solid products such as granular laundry detergent or the like. Because no weight is placed on the dispensing neck 124, the package 110 may be stacked to significant heights without resulting in rupture of any package in the stack or the disruption of the dispensing equipment.

To open the package 110, the user rotates the cover member 128 so that the tab 129 is aligned with the lip indentation 124*b*. The user then grasps the tab 129, placing a finger in the panel indentation 113 between the lateral side panel 112 and the tab 129, and pulls up on the tab 129, tearing or otherwise removing the cover member 128 from the package 110. The user then grasps the seal tab 127 and pulls the seal 126 back, revealing the open end 125 of the dispensing neck 124.

Although the present invention is preferably for use with a standard dispensing machine, alternatively, a large number of the packages of the present invention can be stacked one on top of the other outside of a dispensing machine, for example, on a store shelf, without resulting in damage, leakage or the like to the bottom package or any of the intervening packages. The ability of the dispensing neck 124 and cover member 128 of one package 110 to fit within the recessed area 130 of an overlying package 110 reduces valuable store shelf space required on which to display the packages. Additionally, the ability of the dispensing neck 124 and cover member 128 of one package 110 to fit within the recessed area 130 of an overlying package 110 aids in packaging a large number of packages 110 in bulk for shipping and/or sampling outside of dispensing machines.

Figure 4:
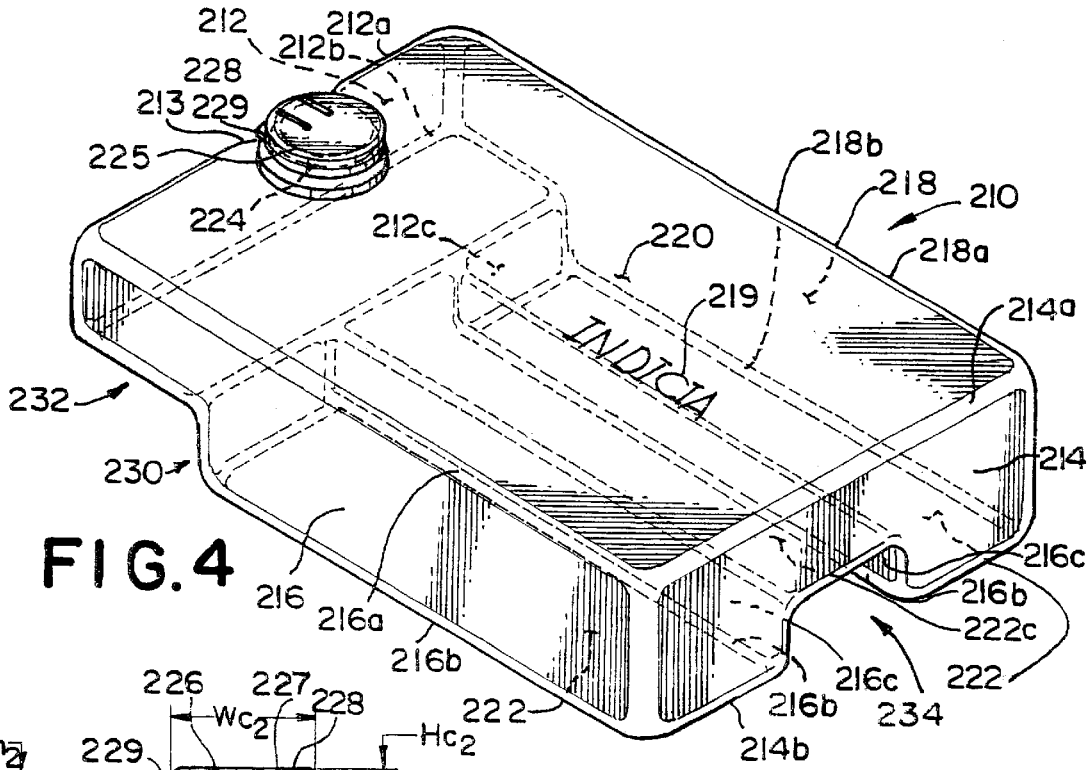
FIG. 4 is a perspective view of a package in accordance with a second preferred embodiment of the present invention.

FIG. 4 illustrates a package 210 in accordance with a second preferred embodiment of the present invention. Like the first embodiment, the package 210 is generally a parallelepiped container in overall shape with first and second generally parallel opposite lateral side panels 212 (in phantom), 214, first and second generally parallel opposite longitudinal side panels 216, 218 (in phantom) and generally parallel opposite top and bottom panels 220, 222 (in phantom), respectively. Each side panel 212, 214, 216, 218 is interconnected with adjacent side panels as shown in FIG. 4. Each side panel 212, 214, 216, 218 has an upper edge 212*a*, 214*a*, 216*a*, 218*a* and a lower edge 212*b*, 214*b*, 216*b*, 218*b*, respectively.

The top panel 220 extends from and interconnects the upper edges 212*a*, 214*a*, 216*a*, 218*a*, of each of the side panels 212, 214, 216, 218, respectively. The top panel 220 also includes a generally cylindrically shaped dispensing neck 224 extending generally upwardly from the plane of the top panel 220. Preferably, part of one of the panels 212, 214, 216, 218 (panel 212 as shown in FIGS. 4–6) includes a panel indentation 213 proximate to the dispensing neck 224.

Preferably, the dispensing neck 224 is generally located proximate to an edge formed by the top panel 220 and the upper edges 212*a*, 214*a*, 216*a*, 218*a* of an adjacent side panel 212, 214, 216, 218, respectively. In the illustrated embodiment, indicia 219 in the form of a preprinted label, is secured to the top panel 220 by a suitable adhesive. However, it will be appreciated by those skilled in the art that the indicia 219 could be applied to the top panel 220 in any other manner and, if desired, could be formed as an integral or molded in part of the top panel 220 during the manufacturing process.

Preferably, the dispensing neck 224 is right circular cylindrically shaped, although those skilled in the art will realize that the dispensing neck 224 can be other shapes, including, but not limited to, right oval cylindrically shaped or frusto-conically shaped. Referring to FIGS. 5–6, the dispensing neck 224 has a tapered lip 224*a* surrounding an open end 225, a predetermined length $L_{n2}$, a predetermined width $W_{n2}$, and a predetermined height $H_{n2}$. The lip 224*a* has a lip indentation 224*b* aligned with the panel indentation 213.

Figure 5:
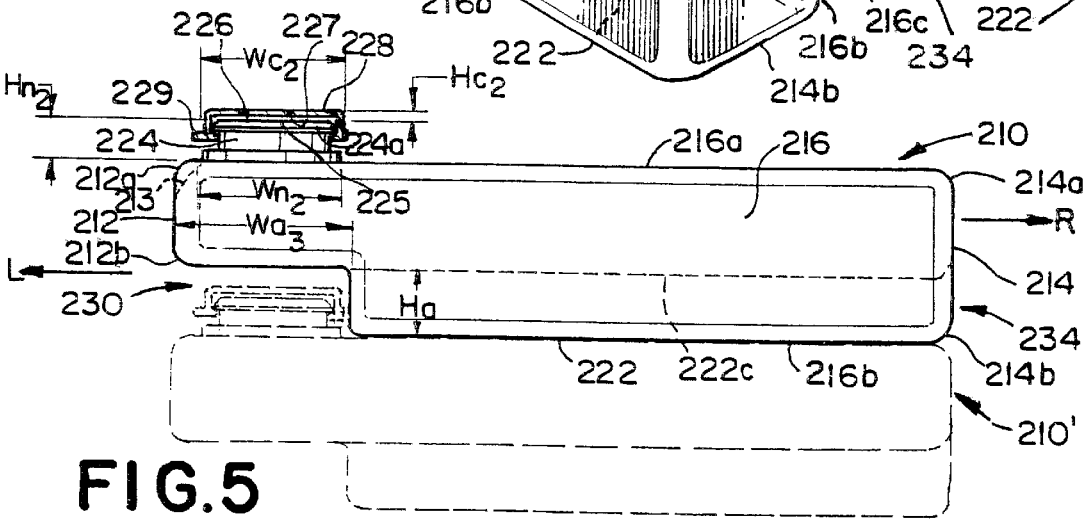
FIG. 5 is a longitudinal side elevational view, partially in section, of the package of FIG. 4 overlying a second package shown in phantom.
Figure 6:
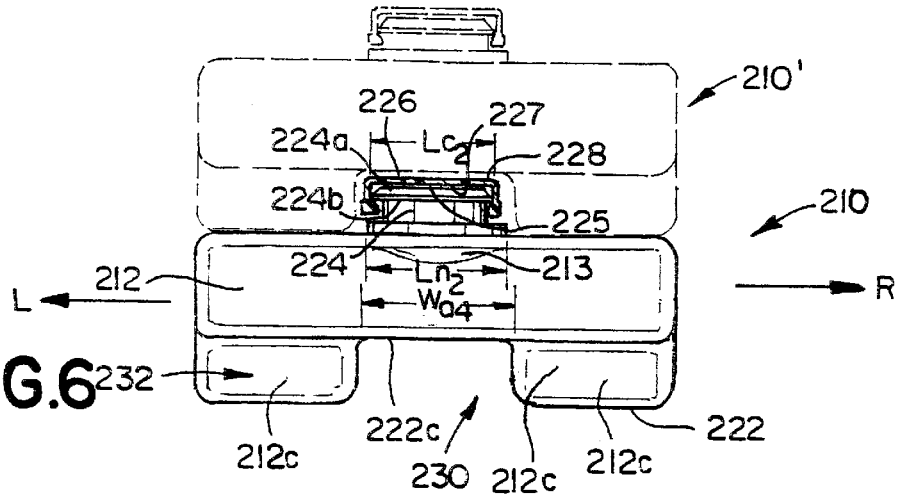
FIG. 6 is a lateral left side elevational view, partially in section, of the package of FIG. 4 underlying a second package shown in phantom.

In the second embodiment, as shown in FIGS. 5–6, the dispensing neck 224 is sealed by a seal 226 which is removably disposed over the open end 225 of the dispensing neck 224. Preferably, the seal 226 includes a tab 227, which a user can grasp to remove the seal 226 from the dispensing neck 224. Preferably, the seal 226 is made of Tyvek® or some other breathable fabric to allow gases which may build up in the package 210 to be released from the package 210 without leaking any product held within the package 210. Alternatively, the seal 226 can be selected from the group consisting of polymeric films, aluminum foils, metallic foils, paper foils, leak proof films, leak proof foils, polypropylene, polyvinyl chloride, polyethylene, and polystyrene. The seal 226 can be secured to the dispensing neck 224 by one of an adhesive, induction sealing, and sonic welding or other comparable methods known to those skilled in the art.

Preferably, the seal 226 is covered by a cover member 228 which is rotatably affixed over the lip 224*a* of the dispensing neck 224. The cover member 228 also includes a tab 229. The cover member 228 is preferably a child proof or child resistant closure. The cover member 228 has a predetermined length $L_{c2}$, a predetermined width $W_{c2}$, and a predetermined height $H_{c2}$ above the dispensing neck 224. The cover member 228 can be of a type that must be torn or otherwise damaged to be removed from the package 210, precluding the reuse of the cover member 228 on the package 210. Alternatively, a screw-on cap (not shown) can be used with a threaded dispensing neck (not shown), permitting the package 210 to be opened and re-closed for partial dispensing of the product contained therein and/or resealing of the package 210. It should be understood by those of ordinary skill in the art that the package 210 and, in particular, the dispensing neck 224 could alternatively be closed in some other manner. For example, the open end 225 of the dispensing neck 224 could be covered by a resealable or non-resealable foil, a flip-top cap or the like. Accordingly, the present invention is not limited to a particular manner in which the package 210 may be initially closed or subsequently re-closed or even whether the package may be reclosable. However, those skilled in the art will also realize that the cover member 228 with tab 229 can be omitted without departing from the spirit and scope of the present invention. The lip 224*a* can also be omitted, and the open end 225 of the dispensing neck 224 can be flat, instead of tapered.

The bottom panel 222 extends from and interconnects the lower edges 212*b*, 214*b*, 216*b*, 218*b* of each of the side panels 212, 214, 216, 218, respectively. The package 210 includes a recessed area 230 on the bottom panel 222. The recessed area 230 is formed by panels 212*c*, 216*c*, 218*c* and 222*c* as shown in FIG. 4. As with the first embodiment, the recessed area 230 is formed by a pair of intersecting grooves 232, 234 extending through the bottom panel 222. The first groove 232 preferably extends along the entire length of one of the first and second lateral side panels 212, 214 between the longitudinal side panels 216 and 218. The second groove 234 extends between the lateral side panels 212 and 214, and is preferably located between the longitudinal side panels 216 and 218. More preferably, the second groove 234 is located generally centrally between the longitudinal side panels 216 and 218, as shown in FIG. 6. However, those skilled in the art will realize that the first groove 232 can extend along the entire length of one of the first and second longitudinal side panels 216, 218 between the lateral side panels 212, 214 and the second groove. 234 can extend between the longitudinal side panels 216, 218, located between the lateral side panels 212, 214. The first and second grooves 232, 234 intersect at a location which is generally aligned with the dispensing neck 224.

As seen in FIG. 5, the first groove 232 has a width $W_{a3}$ which is at least slightly greater than one of the longer and the wider of a combination of the dispensing neck 224 and the cover member 228. Likewise, as seen in FIG. 6, the second groove 234 has a width $W_{a4}$ which is at least slightly greater than the other of the longer and the wider of the combination of the dispensing neck 224 and the cover member 228.

Additionally, a height $H_{a2}$ of the recessed area 230 is slightly greater than a combination of the height $H_{n2}$ of the dispensing neck 224 and the height $H_{c2}$ of the cover member 228 disposed above the dispensing neck 224. The recessed area 230 thus effectively establishes clearance sufficient to permit the stacking of a plurality of packages 210, one on top of the other within standard dispensing equipment (not shown), in a manner illustrated in FIGS. 5 and 6 so that the cover member 228 and the dispensing neck 224 of each underlying package 210' (in FIG. 5), 210 (in FIG. 6) is received within the recessed area 230 of an overlying package 210 (in FIG. 5), 110' (in FIG. 6). In this manner, the cover member 228 and the dispensing neck 224 of each underlying package 210 do not engage the bottom panel 222 of any overlying package 210 and therefore do not bear the weight of any packages stacked thereon. It will be appreciated that by positioning the dispensing neck 224 within the recessed area 230 of an overlying package, it is feasible to dispense the bottommost, the topmost, or any other package 210, 210' from a series of stacked packages for dispensing from the standard dispensing equipment by merely displacing the package 210, 210' in either of a first and second longitudinal and a first and second lateral direction, i.e. toward the left or right (arrows "L" and "R", respectively) when viewing FIG. 5 or toward the left or right (arrows "L" and "R", respectively) when viewing FIG. 6.

An intersection of any panel 212, 212*c*, 214, 216, 216*c*, 218, 218*c*, 220, 222, 222*c* with an adjacent panel 212, 212*c*, 214, 216, 216*c*, 218, 218*c*, 220, 222, 222*c*forms an edge. An intersection of any panel 212, 212*c*, 214, 216, 216*c*, 218, 218*c*, 220, 222, 222*c* with two adjacent panels 212, 212*c*, 214, 216, 216*c*, 218, 218*c*, 220, 222, 222*c* forms a comer. Preferably, any and all edges and comers that are formed on the package 210 are rounded. The rounding relieves stress concentrations at the comers and edges.

It will be appreciated by those skilled in the art that the dispensing neck 224 may be located in virtually any position on the top panel of the package 210, as long as the grooves 232, 234 on the bottom panel 222 of the package 210 are suitably positioned with respect to the dispensing neck 224 so that when the packages 210 are stacked, the dispensing neck 224 of each of the underlying packages 210 is located within both of the grooves 232, 234 of the overlying package 210.

By having the dispensing neck 224 extend above the plane of the top panel 220 of the container 210, the level of any liquid in the container, when stored in an upright level condition, is never high enough to be in contact with an interior of the seal 226. In this manner, the potential for deterioration of the seal 226 and subsequent product leakage is diminished.

Like the above-described embodiment, the package 210 is preferably made of a strong polymeric material to provide a strong, lightweight, inexpensive package which guards against leakage of a product contained therein. Preferably, the package 210 is made utilizing a known molding or blow molding process in a manner well known to those of ordinary skill in the art.

It will also be appreciated by those of ordinary skill in the art that while the present package 210 may be best suited to dispense liquid products, the package 210 could be used for dispensing solid or semi-solid products such as granular laundry detergent or the like. Because no weight is placed on the dispensing neck 224, the package 210 may be stacked to significant heights without resulting in rupture of any package in the stack or the disruption of the dispensing equipment.

Although the present invention is preferably for use with a standard dispensing machine, alternatively, a large number of the packages of the present invention can be stacked one on top of the other outside of a dispensing machine, for example, on a store shelf, without resulting in damage, leakage or the like to the bottom package or any of the intervening packages. The ability of the dispensing neck 224 and cover member 228 of one package 210 to fit within the recessed area 230 of an overlying package 210 reduces valuable store shelf space required on which to display the packages. Additionally, the ability of the dispensing neck 224 and cover member 228 of one package 210 to fit within the recessed area 230 of an overlying package 210 aids in packaging a large number of packages 210 in bulk for shipping and/or sampling outside of dispensing machines.

The package 210 is opened in a manner similar to the opening of the package 110, described above.

Figure 7:
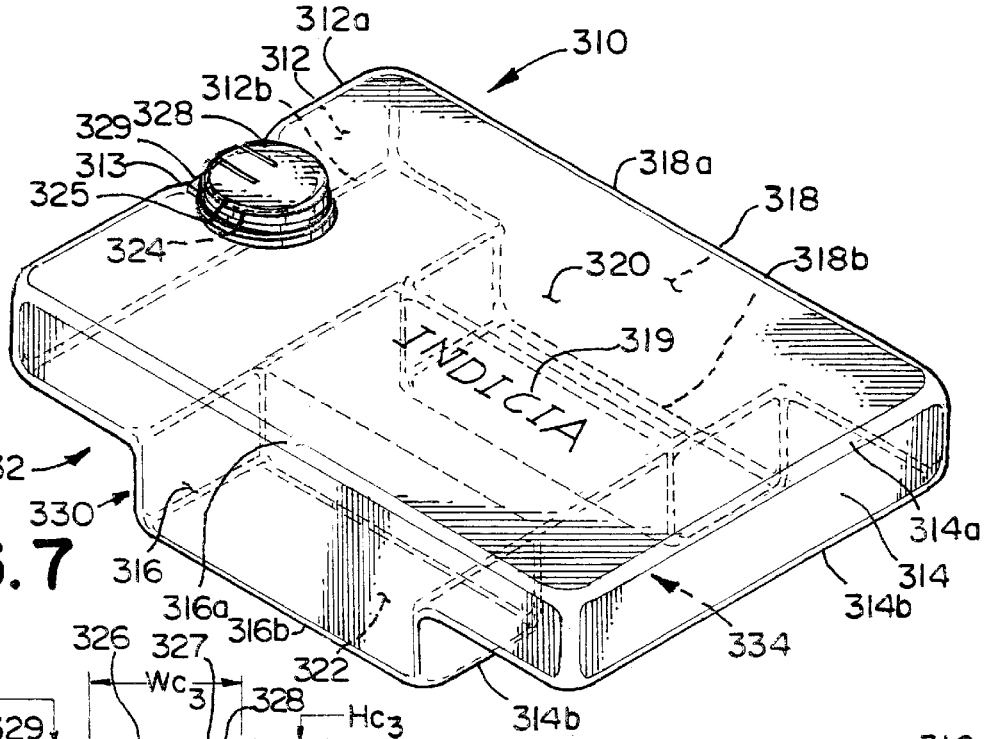
FIG. 7 is a perspective view of a package in accordance with a third preferred embodiment of the present invention.

FIG. 7 illustrates a package 310 in accordance with a third preferred embodiment of the present invention. Like the first embodiment, the package 310 is generally a parallelepiped container in overall shape with first and second generally parallel opposite lateral side panels 312 (in phantom), 314, first and second generally parallel opposite longitudinal side panels 316, 318 (in phantom) and generally parallel opposite top and bottom panels 320, 322 (in phantom), respectively. Each side panel 312, 314, 316, 318 is interconnected with adjacent side panels as shown in FIG. 74. Each side panel 312, 314, 316, 318 has an upper edge 312*a*, 314*a*, 316*a*, 318*a* and a lower edge 312*b*, 314*b*, 316*b*, 318*b*, respectively.

The top panel 320 extends from and interconnects the upper edges 312*a*, 314*a*, 316*a*, 318*a*, of each of the side panels 312, 314, 316, 318, respectively. The top panel 320 also includes a generally cylindrically shaped dispensing neck 324 extending generally upwardly from the plane of the top panel 320. Preferably, part of one of the panels 312, 314, 316, 318 (panel 312 as shown in FIGS. 7–9) includes a panel indentation 313 proximate to the dispensing neck 324.

Preferably, the dispensing neck 324 is generally located proximate to an edge formed by the top panel 320 and the upper edges 312*a*, 314*a*, 316*a*, 318*a* of an adjacent side panel 312, 314, 316, 318, respectively. In the illustrated embodiment, indicia 319 in the form of a preprinted label, is secured to the top panel 320 by a suitable adhesive. However, it will be appreciated by those skilled in the art that the indicia 319 could be applied to the top panel 320 in any other manner and, if desired, could be formed as an integral or molded in part of the top panel 320 during the manufacturing process.

Preferably, the dispensing neck 324 is right circular cylindrically shaped, although those skilled in the art will realize that the dispensing neck 324 can be other shapes, including, but not limited to, right oval cylindrically shaped or frusto-conically shaped. Referring to FIGS. 6–9, the dispensing neck 324 has a tapered lip 324*a* surrounding an open end 325, a predetermined length $L_{n3}$, a predetermined width $W_{n3}$, and a predetermined height $H_{n3}$. The lip 324*a* has a lip indentation 324*b* aligned with the panel indentation 313.

Figure 8:
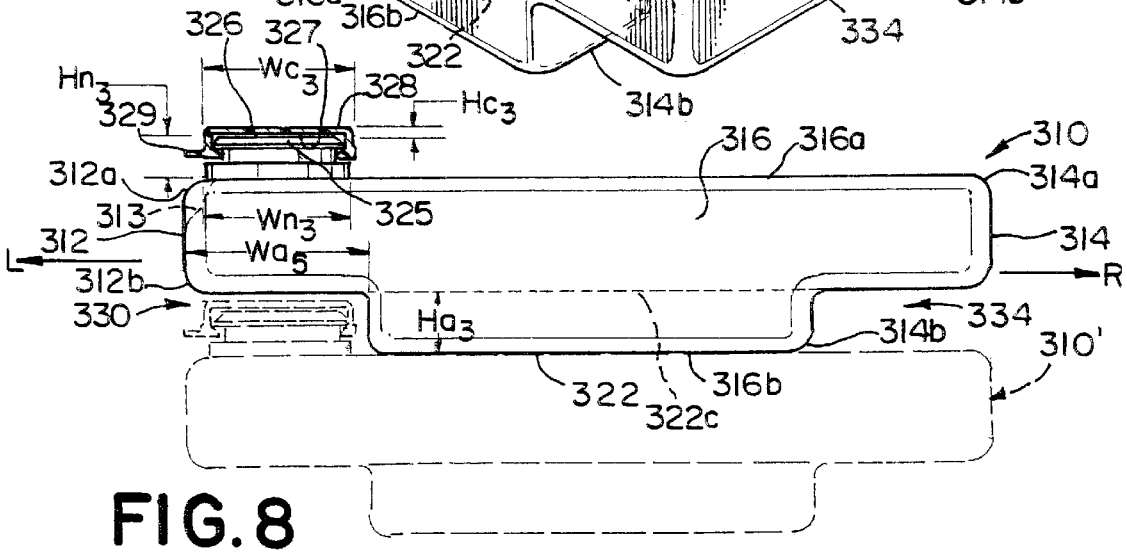
FIG. 8 is a longitudinal side elevational view, partially in section, of the package of FIG. 7 overlying a second package shown in phantom.
Figure 9:
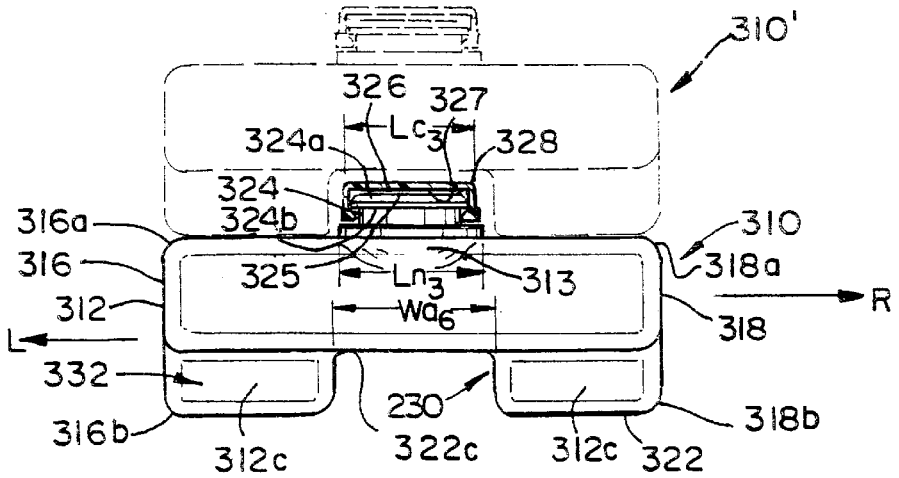
FIG. 9 is a lateral left side elevational view, partially in section, of the package of FIG. 7 underlying a second package shown in phantom.

In the third embodiment, as shown in FIGS. 8–9, the dispensing neck 324 is sealed by a seal 326 which is removably disposed over the open end 325 of the dispensing neck 324. Preferably, the seal 326 includes a tab 327, which a user can grasp to remove the seal 326 from the dispensing neck 324. Preferably, the seal 326 is made of Tyvek® or some other breathable fabric to allow gases which may build up in the package 310 to be released from the package 310 without leaking any product held within the package 310. Alternatively, the seal 326 can be selected from the group consisting of polymeric films, aluminum foils, metallic foils, paper foils, leak proof films, leak proof foils, polypropylene, polyvinyl chloride, polyethylene, and polystyrene. The seal 326 can be secured to the dispensing neck 324 by one of an adhesive, induction sealing, and sonic welding or other comparable methods known to those skilled in the art.

Preferably, the seal 326 is covered by a cover member 328 which is rotatably affixed over the lip 324*a* of the dispensing neck 324. The cover member 328 also includes a tab 329. The cover member 328 is preferably a child proof or child resistant closure. The cover member 328 has a predetermined length $L_{c3}$, a predetermined width $W_{c3}$, and a predetermined height $H_{c3}$ above the dispensing neck 324. The cover member 328 can be of a type that must be torn or otherwise damaged to be removed from the package 310, precluding the reuse of the cover member 328 on the package 310. Alternatively, a screw-on cap (not shown) can be used with a threaded dispensing neck (not shown), permitting the package 310 to be opened and re-closed for partial dispensing of the product contained therein and/or resealing of the package 310. It should be understood by those of ordinary skill in the art that the package 310 and, in particular, the dispensing neck 324 could alternatively be closed in some other manner. For example, the open end 325 of the dispensing neck 324 could be covered by a resealable or non-resealable foil, a flip-top cap or the like. Accordingly, the present invention is not limited to a particular manner in which the package 310 may be initially closed or subsequently re-closed or even whether the package may be reclosable. However, those skilled in the art will also realize that the cover member 328 with tab 329 can be omitted without departing from the spirit and scope of the present invention. The lip 324*a* can also be omitted, and the open end 325 of the dispensing neck 324 can be flat, instead of tapered.

The bottom panel 322 extends from and interconnects the lower edges 312*b*, 314*b*, 316*b*, 318*b* of each of the side panels 312, 314, 316, 318, respectively. The recessed area 330 is formed by panels 312*c*, 314*c*, 316*c*, 318*c* and 322*c* as shown in FIG. 7. As with the second embodiment, the recessed area 330 is formed by a pair of intersecting grooves 332, 334 extending through the bottom panel 322. The first groove 332 preferably extends along the entire length of one of the first and second lateral side panels 312, 314 between the longitudinal side panels 316 and 318. The second groove 334 extends between the lateral side panels 312 and 314, and is preferably located between the longitudinal side panels 316 and 318. More preferably, the second groove 334 is located generally centrally between the longitudinal side panels 316 and 318, as shown in FIG. 8. Additionally, a third groove 336 preferably extends along the entire length of the other of the first and second lateral side panels 312, 314 between the longitudinal side panels 316 and 318. The third groove 336 allows for generally equal weight distribution of the product disposed within the package 310, permitting easier dispensing from a dispensing machine. However, those skilled in the art will realize that the first groove 332 can extend along the entire length of one of the first and second longitudinal side panels 316, 318 between the lateral side panels 312, 314, the second groove 334 can extend between the longitudinal side panels 316, 318, located between the lateral side panels 312, 314, and the third groove can extend along the entire length of the other of the first and second longitudinal side panels 316, 318. One of the first and second grooves 332, 334 and the second and third grooves 334, 336 intersect at a location which is generally aligned with the dispensing neck 324.

As seen in FIG. 8, the first and third grooves 332, 336 each have a width $W_{a5}$ which is at least slightly greater than one of the longer and the wider of a combination of the dispensing neck 324 and the cover member 328. Likewise, as seen in FIG. 9, the second groove 334 has a width $W_{a6}$ which is at least slightly greater than the other of the longer and the wider of the combination of the dispensing neck 324 and the cover member 328.

Additionally, a height $H_{a4}$ of the recessed area 330 is slightly greater than a combination of the height $H_{n3}$ of the dispensing neck 324 and the height $H_{c3}$ of the cover member 328 disposed above the dispensing neck 324. The recessed area 330 thus effectively establishes clearance sufficient to permit the stacking of a plurality of packages 310, one on top of the other within standard dispensing equipment (not shown), in a manner illustrated in FIGS. 8 and 9 so that the cover member 328 and the dispensing neck 324 of each underlying package 310' (in FIG. 8), 310 (in FIG. 9) is received within the recessed area 330 of an overlying package 310 (in FIG. 8), 310' (in FIG. 9). In this manner, the cover member 328 and the dispensing neck 324 of each underlying package 310 do not engage the bottom panel 322 of any overlying package 310 and therefore do not bear the weight of any packages stacked thereon. It will be appreciated that by positioning the dispensing neck 324 within the recessed area 330 of an overlying package, it is feasible to dispense the bottommost, the topmost, or any other package 310, 310' from a series of stacked packages for dispensing from the standard dispensing equipment by merely displacing the package 310, 310' in either of a first and second longitudinal and a first and second lateral direction, i.e. toward the left or right (arrows "L" and "R", respectively) when viewing FIG. 8 or toward the left or right (arrows "L" and "R", respectively) when viewing FIG. 9.

An intersection of any panel 312, 312*c*, 314, 314*c*, 316, 316*c*, 318, 318*c*, 320, 322, 322*c* with an adjacent panel 312, 312*c*, 314, 314*c*, 316, 316*c*, 318, 318*c*, 320, 322, 322*c* forms an edge. An intersection of any panel 312, 312*c*, 314, 314*c*, 316, 316*c*, 318, 318*c*, 320, 322, 322*c* with two adjacent panels 312, 312*c*, 314, 314*c*, 316, 316*c*, 318, 318*c*, 320, 322, 322*c* forms a comer. Preferably, any and all edges and comers that are formed on the package 310 are rounded. The rounding relieves stress concentrations at the comers and edges.

By having the dispensing neck 324 extend above the plaiie of the top panel 320 of the container 310, the level of any liquid in the container, when stored in an upright level condition, is never high enough to be in contact with an interior of the seal 326. In this manner, the potential for deterioration of the seal 326 and subsequent product leakage is diminished.

Preferably, the package 310 is made of a strong polymeric material, such as a polypropylene, polyvinyl chloride, polyethylene, polystyrene or the like in monolayers or multilayers in order to provide a strong, lightweight, inexpensive package which guards against leakage of any product contained therein. Preferably, the package 310 is made utilizing a known molding or blow molding process in a manner well known to those of ordinary skill in the art.

It will also be appreciated by those of ordinary skill in the art that while the present package 310 may be best suited to dispense liquid products, the package 310 could be used for dispensing solid or semi-solid products such as granular laundry detergent or the like. Because no weight is placed on the dispensing neck 324, the package 310 may be stacked to significant heights without resulting in rupture of any package in the stack or the disruption of the dispensing equipment.

It will be appreciated by those skilled in the art that the dispensing neck 324 may be located in virtually any position on the top panel of the package 310, as long as the grooves 332, 334, 336 on the bottom panel 322 of the package 310 are suitably positioned with respect to the dispensing neck 324 so that when the packages 310 are stacked, the dispensing neck 324 of each of the underlying packages 310 is located within both of either the grooves 332, 334 (as shown in FIG. 7) or the grooves 334, 336 (not shown) of the overlying package 310. The third groove 336 allows a number of packages 310 to be stacked one on top of each other without requiring the dispensing necks 324 of each package 310 to all be located in the intersection of the first groove 332 and the second grove 234 of the overlying package 310'. The dispensing necks 324 can be located in the intersection of the second groove 234 and the third groove 236 of the overlying package 310' (not shown) without adversely affecting the stacking and/or dispensing capabilities of the package 310.

Although the present invention is preferably for use with a standard dispensing machine, alternatively, a large number of the packages of the present invention can be stacked one on top of the other outside of a dispensing machine, for example, on a store shelf, without resulting in damage, leakage or the like to the bottom package or any of the intervening packages. The ability of the dispensing neck 324 and cover member 328 of one package 310 to fit within the recessed area 330 of an overlying package 310 reduces valuable store shelf space required on which to display the packages. Additionally, the ability of the dispensing neck 324 and cover member 328 of one package 310 to fit within the recessed area 330 of an overlying package 310 aids in packaging a large number of packages 310 in bulk for shipping and/or sampling outside of dispensing machines.

The package 310 is opened in a manner similar to the opening of either of the packages 110, 210 described above.

From the foregoing description of the preferred embodiments, it can be seen that the present invention comprises a package suitable for containing many different products and also well suited for use in a dispensing or vending machine. It will be appreciated by those skilled in the art that modifications may be made from the described embodiment without departing from the scope and spirit of the invention as defined by the appended claims.

What is claimed is:

1. A package for containing a product for use with standard dispensing equipment comprising:

a generally parallelepiped container including first and second lateral, generally parallel, opposite side panels and first and second longitudinal, generally parallel, opposite side panels, each side panel being interconnected with adjacent side panels, and each side panel having a lower edge and an upper edge, the container further including a bottom panel extending from and interconnecting the lower edges of each of the lateral and longitudinal side panels, and a top panel extending from and interconnecting the upper edges of each of the lateral and longitudinal side panels;

a dispensing neck extending generally upwardly from the top panel, the dispensing neck having an open end, a predetermined length, a predetermined width and a predetermined height; and a cover member removably disposed over the open end of the dispensing neck, the cover member having a predetermined length, a predetermined width and a predetermined height, the bottom panel having a recessed area, the recessed area including a first groove extending between the first and second longitudinal side panels of the package and having a width at least slightly greater than one of the longer and the wider of the dispensing neck and the cover member, and a second groove extending between the first and second lateral side panels of the package and having a width at least slightly greater than the other of the longer and the wider of the dispensing neck and the cover member, an intersection of the first and second grooves being generally aligned with the dispensing neck, the recessed area further having a height at least slightly greater than the height of a combination of the dispensing neck and the cover member disposed on the dispensing neck whereby when a plurality of such packages are stacked one on top of another within standard dispensing equipment, the dispensing neck and the cover member of each underlying package is received within the recessed area of an overlying package such that none of the weight of any overlying package is borne by the cover member and dispensing neck of an underlying package and so that a package can be displaced in any one of a first and second lateral and a first and second longitudinal direction from the stack of packages for dispensing from the standard dispensing equipment.

2. A package according to claim 1 wherein the first groove extends along the first lateral side panel.

3. A package according to claim 2 wherein the second groove extends along a longitudinal side panel.

4. A package according to claim 3 wherein the neck is located proximate to an edge formed by an intersection of the top panel with an adjacent side panel.

5. A package according to claim 2 wherein the second groove is located generally centrally between the first and second longitudinal side panels.

6. A package according to claim 5 wherein the neck is located proximate to an edge formed by an intersection of the top panel with an adjacent side panel.

7. A package according to claim 5 wherein the recessed area further includes a third groove extending between the first and second longitudinal side panels of the package and having a width at least slightly greater than one of the longer and the wider of the dispensing neck and the cover member, the third groove extending along the second lateral side panel.

8. A package according to claim 1 wherein the cover member is secured to the dispensing neck by one of an adhesive, induction sealing, sonic welding, screw fit, and snapfit.

9. A package according to claim 1 wherein the container is made from a polymeric material.

10. A package according to claim 1 wherein the cover member is selected from the group consisting of polymeric films, aluminum foils, metallic foils, paper foils, leak proof films, leak proof foils, polypropylene, polyvinyl chloride, polyethylene, and polystyrene.

11. A package for containing a product comprising:

a generally parallelepiped container including first and second lateral, generally parallel, opposite side panels and first and second longitudinal, generally parallel, opposite side panels, each side panel being interconnected with adjacent side panels, and each side panel having a lower edge and an upper edge, the container further including a bottom panel extending from and interconnecting the lower edges of each of the lateral and longitudinal side panels, and a top panel extending from and interconnecting the upper edges of each of the lateral and longitudinal side panels;

a dispensing neck extending generally upwardly from the top panel, the dispensing neck having an open end, a predetermined length, a predetermined width and a predetermined height; and a cover member removably disposed over the open end of the dispensing neck, the cover member having a predetermined length, a predetermined width and a predetermined height, the bottom panel having a recessed area, the recessed area including a first groove extending between the first and second longitudinal side panels of the package and having a width at least slightly greater than one of the longer and the wider of the dispensing neck and the cover member, and a second groove extending between the first and second lateral side panels of the package and having a width at least slightly greater than the other of the longer and the wider of the dispensing neck and the cover member, an intersection of the first and second grooves being generally aligned with the dispensing neck, the recessed area further having a height at least slightly greater than the height of a combination of the dispensing neck and the cover member disposed on the dispensing neck whereby when a plurality of such packages are stacked one on top of another, the dispensing neck and the cover member of each underlying package is received within the recessed area of an overlying package such that none of the weight of any overlying package is borne by the cover member and dispensing neck of an underlying package.

12. A package according to claim 11 wherein the first groove extends along a lateral side panel.

13. A package according to claim 12 wherein the second groove extends along a longitudinal side panel.

14. A package according to claim 13 wherein the neck is located proximate to a corner formed by an intersection of the top panel with two adjacent side panels.

15. A package according to claim 11 wherein the second groove is located generally centrally between the first and second longitudinal side panels.

16. A package according to claim 15 wherein the neck is located proximate to an edge formed by an intersection of the top panel with an adjacent side panel.

17. A package according to claim 14 wherein the recessed area further includes a third groove extending between the first and second longitudinal side panels of the package and having a width at least slightly greater than one of the longer and the wider of the dispensing neck and the cover member, the third groove extending along the second lateral side panel.

18. A package according to claim 11 wherein the cover member is secured to the dispensing neck by one of an adhesive, induction sealing, sonic welding, screw fit, and snapfit.

19. A package according to claim 11 wherein the container is made from a polymeric material.

20. A package according to claim 11 wherein the cover member is selected from the group consisting of polymeric films, aluminum foils, metallic foils, paper foils, leak proof films, leak proof foils, polypropylene, polyvinyl chloride, polyethylene, and polystyrene.

* * * * *